US009005000B2

(12) United States Patent
Jenkins

(10) Patent No.: US 9,005,000 B2
(45) Date of Patent: Apr. 14, 2015

(54) REUSABLE CARD-BASED GAMING SYSTEM AND METHOD

(75) Inventor: Deborah L. Jenkins, Fort Worth, TX (US)

(73) Assignee: Kingdom Resources, LLC, Fort Worth, TX (US)

( * ) Notice: Subject to any disclaimer, the term of this patent is extended or adjusted under 35 U.S.C. 154(b) by 1771 days.

(21) Appl. No.: 12/211,625

(22) Filed: Sep. 16, 2008

(65) Prior Publication Data

US 2010/0066019 A1 Mar. 18, 2010

(51) Int. Cl.

| | |
|---|---|
| ***A63F 9/24*** | (2006.01) |
| ***A63F 1/00*** | (2006.01) |
| ***A63F 1/04*** | (2006.01) |
| ***A63F 3/06*** | (2006.01) |

(52) U.S. Cl.

CPC .. *A63F 1/04* (2013.01); *A63F 3/065* (2013.01)

(58) Field of Classification Search

USPC ..... 273/292

See application file for complete search history.

(56) References Cited

U.S. PATENT DOCUMENTS

| | | | | |
|---|---|---|---|---|
| 6,168,521 | B1 * | 1/2001 | Luciano et al. | 463/18 |
| 7,887,405 | B2 * | 2/2011 | Schneier et al. | 463/17 |
| 2005/0075160 | A1 * | 4/2005 | Weil et al. | 463/17 |

* cited by examiner

*Primary Examiner* — Xuan Thai
*Assistant Examiner* — Michael Grant
(74) *Attorney, Agent, or Firm* — Feldman Gale, P.A.; Rafael Perez-Pineiro

(57) ABSTRACT

An apparatus for gaming, comprising a card reader system for reading card data from a game card associated with a player. An instant win game system for associating an instant win game entry with the card data. A jackpot game system for associating a jackpot game entry with the card data.

19 Claims, 3 Drawing Sheets

REUSABLE CARD-BASED GAMING SYSTEM AND METHOD

FIELD OF THE INVENTION

The invention relates to game systems, and more particularly to a system and method for a reusable card-based game that allows a user to reuse a durable card or use a virtual card to participate in the game.

BACKGROUND OF THE INVENTION

Gaming systems such as lotteries are known in the art. Such gaming systems typically utilize disposable "scratch-off" cards for instant-win type games, or disposable paper tickets for jackpot type games. The single-use type aspect of such game pieces makes them susceptible to fraud, where a player may purchase a game ticket only to find out that the ticket is counterfeit.

SUMMARY OF THE INVENTION

In accordance with the present invention, a reusable card-based gaming system and method are provided for that provide for improved security and greater flexibility in game design.

In accordance with an exemplary embodiment of the present invention, an apparatus for gaming is provided. The apparatus includes a card reader system for reading card data from a reusable game card associated with a player, such as a smart card or a magnetic stripe card, and which also allows a virtual card to be used. An instant win game system associates an instant win game entry with the card data, such as to allow the player to see whether they have won an instant win game. A jackpot game system associates a jackpot game entry with the card data, such as to enter the player in the jackpot game.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
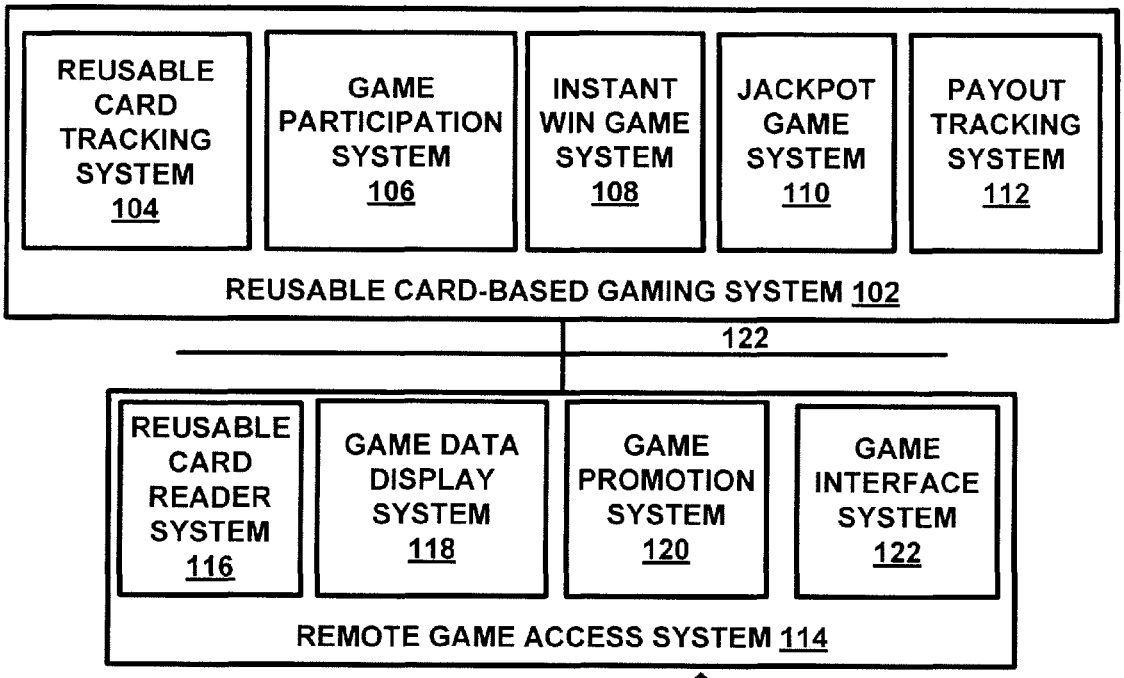
FIG. 1 is a diagram of a system for reusable card based gaming in accordance with an exemplary embodiment of the present invention.

In the description that follows, like parts are marked throughout the specification and drawings with the same reference numerals, respectively. The drawing figures might not be to scale, and certain components can be shown in generalized or schematic form and identified by commercial designations in the interest of clarity and conciseness.

FIG. 1 is a diagram of a system 100 for reusable card based gaming in accordance with an exemplary embodiment of the present invention. System 100 can be implemented in hardware, software, or a suitable combination of hardware and software, and can be one or more software systems operating on one or more general purpose processing platforms. As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, databases, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

System 100 includes reusable card based gaming system 102, reusable card tracking system 104, game participation system 106, instant win game system 108, jackpot game system 110, and payout tracking system 112. Reusable card tracking system 104 receives reusable card registration data for a user. In one exemplary embodiment, reusable card tracking system 104 can store a plurality of reusable card identifiers for inactive reusable cards, and can activate the reusable cards and associate a card account with a reusable card. In this exemplary embodiment, the card account can include card owner data, account balance data, card history data, or other suitable data.

Game participation system 106 allows a user to review and select games to participate in. In one exemplary embodiment, game participation system 106 can interface with a plurality of remote game access systems 114, so as to allow users to present a reusable card at a remote game access system 114 and to select games to participate in. Game participation system 106 thus facilitates the use of a reusable card based gaming system with plurality of remote terminals.

Instant win game system 108 allows a user to participate in an instant win game with a reusable card-based gaming system. In one exemplary embodiment, an instant win game for a reusable card based gaming system varies significantly from prior or instant win games, in that the security and integrity of instant win allocations must be maintained. Instant win game system 108 thus allows a reusable card based gaming system to provide an instant win game in a manner that a user can confirm that instant win chances are not being arbitrarily selected or are otherwise being manipulated.

Jackpot game system 110 provides users with an option for participating in a jackpot game in a reusable card based gaming system. In one exemplary embodiment, jackpot game system 110 can receive a plurality of entries from a plurality of users, and can dynamically generate jackpot odds and pay out amounts. For example, where a jackpot game has one or more prize levels, the odds are winning can be determined by the number of entries. In this exemplary embodiment, the number of entries can be terminated at a time when predetermined odds have been met, the number of entries can be terminated at a predetermined time so as to result in odds that are based on the number of entries, or other suitable processes can be used.

Payout tracking system 112 is used to track the number of payouts for instant win games, jackpot games, or other suitable games. In one exemplary embodiment, payout tracking system 112 can allow a user to verify the number of payouts for a game, to review user specific data for payouts, or can be used for other suitable purposes.

System 100 includes remote game access system 114 and reusable card reader 116, game data display system 118, game promotion system 120, and game interface system 122, each of which can be implemented in hardware, software, or suitable combination of hardware and software, and which can be one or more software systems operating on a general purpose processing platform. Remote game access system 114 is coupled to reusable card based gaming system 102 over communications medium 122, which can be a network, a leased line, a wireless communications channel or other suitable media. In one exemplary embodiment, remote game access system 114 can be implemented as a web browser so as to allow individual users to access reusable card based game system 102 from their own personal computer. Likewise, remote game access system 114 can be a stand alone kiosk or other suitable systems that are operated by predetermined registered game administrators. Other suitable embodiments can also be used.

Reusable card reader system 116 allows a user to present a reusable card and have data stored on the reusable card electronically read. In one exemplary embodiment, reusable card reader system 116 can read smart cards, magnetic stripe cards, or other suitable cards, such as to read hidden data from the card and to confirm the authenticity of the card. Likewise, where a virtual card is used, or where account data associated with a reusable card can be independently used to access a user's account, reusable card reader system 116 is not required for a user to access system 100.

Game data display system 118 generates information pertaining to instant win games, jackpot games, or other suitable games. In one exemplary embodiment, game data display system 118 can be dynamically managed through game participation system 106 so as to generate different game data displays based on the remote game access system 114 that is accessing the game data, such as based on location, time of day, time period or other suitable data.

Game promotion system 120 generates one or more game promotions. In one exemplary embodiment, a game promotion can create an incentive for users to participate in an instant win game when the number of instant win prizes has decreased, such as by awarding additional jackpot game tickets or entries in exchange for a purchased instant win game.

Game interface system 122 allows a user to access game specific data such as payout, time to completion, or other suitable data.

In operation, system 100 allows a reusable card based game to be provided to users. In one exemplary embodiment, users can obtain a reusable card that will be owned by the user, which is used to identify the user so as to allow the user to participate in the card based game. System 100 can provide additional incentives for gaming and games that are not available through prior or gaming systems.

Figure 2:
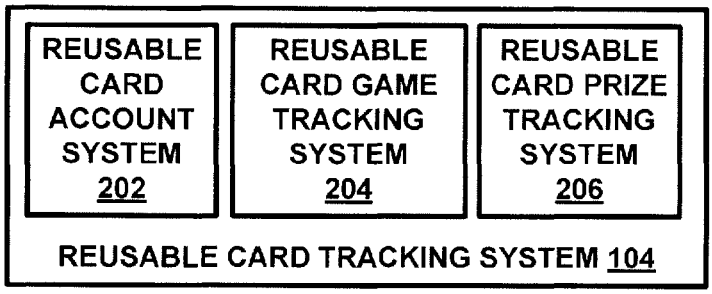
FIG. 2 is a diagram of a system for providing reusable card tracking for a reusable card-based gaming system in according with an exemplary embodiment of the present invention.

FIG. 2 is a diagram of a system 200 for providing reusable card tracking for a reusable card-based gaming system in according with an exemplary embodiment of the present invention. System 200 includes reusable card tracking system 104 and reusable card account system 202, reusable card game tracking system 204, and reusable card prize tracking system 206, each of which can be implemented in hardware, software, or a suitable combination of hardware and software, and which can be one or more software systems operating on a general purpose processing platform.

Reusable card account system 202 stores account data for individual reusable cards. In one exemplary embodiment, reusable card account system 202 can store data for account balances, account funding sources, account win and loss history, and other suitable data. Reusable card account system 202 can also be used to provide data on winnings and losses to other systems, such as systems for recording income tax or other suitable systems.

Reusable card game tracking system 204 tracks one or more active games for a user. In one exemplary embodiment, reusable card game tracking system 204 can track a number of jackpots, instant win games, or other suitable games. For example, where a user has purchased a number of jackpot game entries, reusable card game tracking system 204 can be used to track the number of entries and also to notify the user of the status of the user's entries.

Reusable card prize tracking system 206 is used to track prizes that have been awarded to a user. In one exemplary embodiment, a user can retrieve information regarding prizes that have been awarded, an official or other person can obtain data on prizes that a user has received, or other suitable data can be provided.

In operation, system 200 provides reusable card tracking functionality for a reusable card based game system. System 200 thus allows reusable card owners to be authenticated and prevents fraud or other misuse of a reusable card based gaming system.

Figure 3:
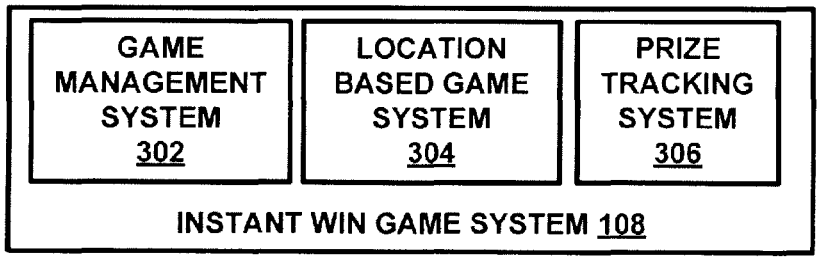
FIG. 3 is a diagram of a system for an instant win game for a reusable card-based gaming system in accordance with an exemplary embodiment of the present invention.

FIG. 3 is a diagram of a system 300 for an instant win game for a reusable card-based gaming system in accordance with an exemplary embodiment of the present invention. System 300 includes instant win game system 108 and game management system 302, location based game system 304 and prize tracking system 306.

Game management system 302 allows an operator to configure one or more instant win games. In one exemplary embodiment, game management system 302 can be used to coordinate promotions, prize levels, or other suitable data.

Location based game system 304 allows a location based instant win game to be operated. In one exemplary embodiment, instant win games can be limited to predetermined vendors, predetermined users, or other suitable location based games.

Prize tracking system 306 tracks instant win game prizes for a reusable card based game system. In one exemplary embodiment, prize tracking system 306 can be used to allocate instant win prizes randomly to predetermined entries, and can be randomly allocate entries based on reusable card based gaming purchases. In one exemplary embodiment, prize tracking system 306 can be used to insure that instant win game amounts are randomly distributed to participants so as to avoid fraud or other misoperation.

In operation, system 300 is used to provide an instant win game for a reusable card based game system, so as to allow instant win games to be readily managed and to avoid prize manipulation.

Figure 4:
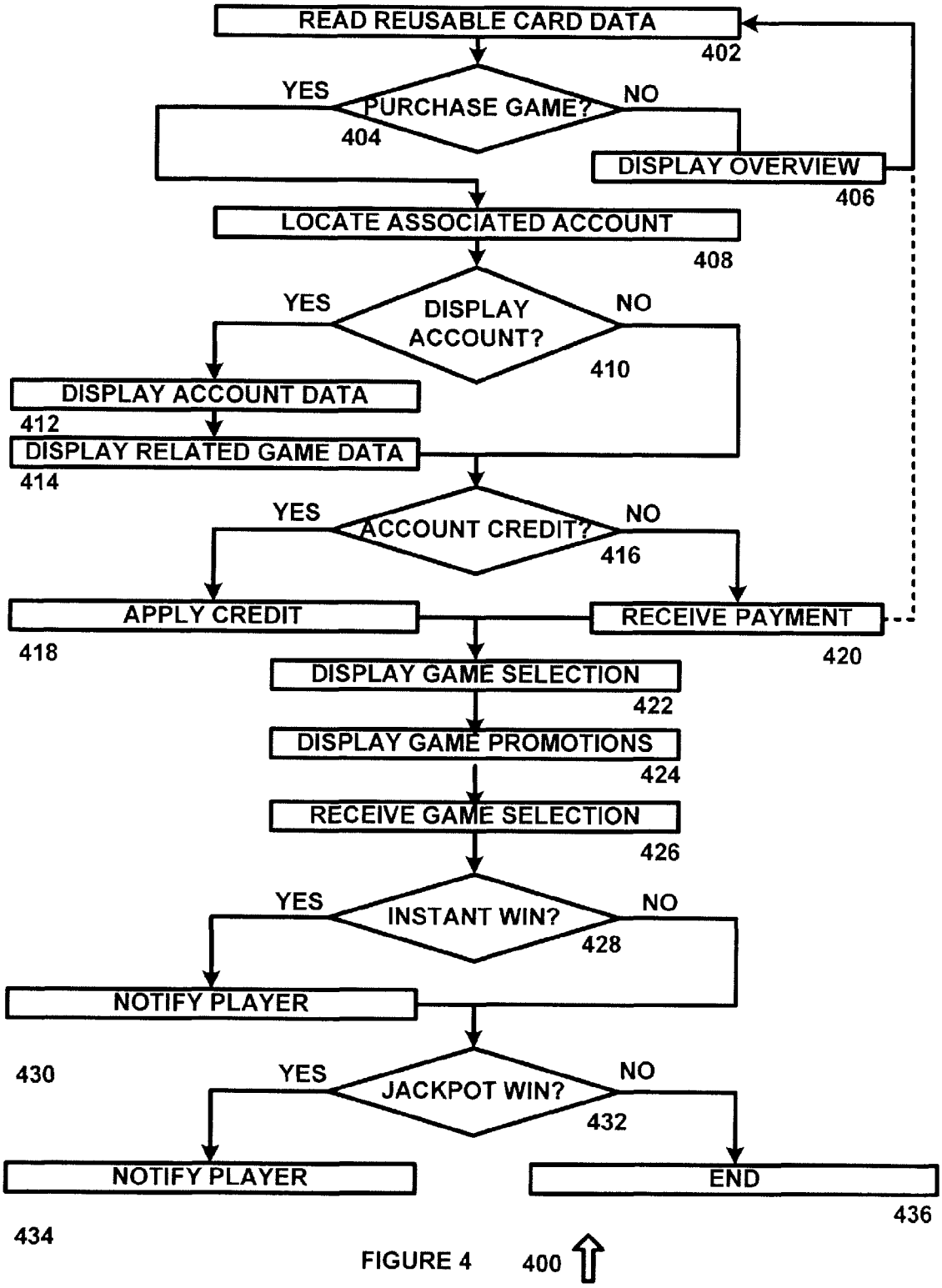
FIG. 4 is a flowchart of a method for reusable card-based gaming in accordance with an exemplary embodiment of the present invention.

FIG. 4 is a flowchart of a method 400 for reusable card-based gaming in accordance with an exemplary embodiment of the present invention. Method 400 begins at 402 where reusable card data is read. In one exemplary embodiment, reusable card data can be read by a card reader at a vendor, a personal card reader, reusable card data can be entered through a web based user interface, or other suitable processes can be used. The method then proceeds to 404.

At 404, it is determined whether a game should be purchased. If it is determined that no game purchase is required, the method proceeds to 406, where general game overview or marketing information is displayed, such as to prevent a user from seeing active game data unless and until payment for a game is received. Otherwise, the method proceeds to 408.

At 408, an associated account for the reusable card data is located. In one exemplary embodiment, an account can be looked up, additional verification processes can be used, such as by comparing stored biometric or password account data with user-entered data, or other suitable processes can be utilized. The method then proceeds to 410.

At 410, it is determined whether a request has been received to display account data. If no request has been received, the method proceeds to 416. Otherwise, the method proceeds to 412 where account data is displayed. The method then proceeds to 414 where related game data is displayed, such as games that a user is currently participating in. The method then proceeds to 416.

At 416, it is determined whether an account credit should be applied to select a game for purchase. If it is determined that no account credit is available, the method proceeds to 420 where payment is received, such as by providing cash to a cash reader, by receiving a purchase confirmation from a vendor, by funding an account from an external source, or by other suitable methods. The method then proceeds to 422, or alternatively can return to 402 as indicated by the dashed line, such as where a user fails to provide additional funding within a predetermined time. Likewise, if it determined an account credit should be applied at 416, the method proceeds to 418 where a credit on the account is applied. The method then proceeds to 422.

At 422, game selections are displayed. The game selections can include a menu of all available games, a menu of games that are available for purchase with the amount of funds received, or other suitable displays. The method proceeds to 424, where game promotions are displayed. In one exemplary embodiment, game promotions can include a listing of promotions for games that are expiring, promotions for games that have a small remaining number of "instant win" amounts available, or other suitable promotional data. The method then proceeds to 426 where a game selection is displayed, such as after a user has entered a selected game. The method then proceeds to 428.

At 428, it is determined whether an instant win has been generated. In one exemplary embodiment, an instant win can be a prize associated with a prize pool where a random selection from the prize pool indicates an instant win prize. Likewise, other suitable instant win amounts can be generated. If it is determined that no instant win has been generated, the method proceeds to 432, otherwise the method proceeds to 430 where the player is notified of the instant win amount. The method then proceeds to 432.

At 432, it is determined whether a jackpot win has been indicated. In one exemplary embodiment, a jackpot win can be for a single drawing that occurs after a predetermined period of time for a game, after a predetermined number of chances have been purchased, or in other suitable manners. If it is determined that no jackpot win has been detected, the method proceeds to 436 and terminates. Otherwise, the method proceeds to 434 where the player is notified that they have won a jackpot, such as by generating audiovisual data, audio data, or in other suitable manners.

In operation, method 400 allows a reusable card based gaming system to be used to allow players to participate in instant win games, jackpot games or other suitable games.

Figure 5:
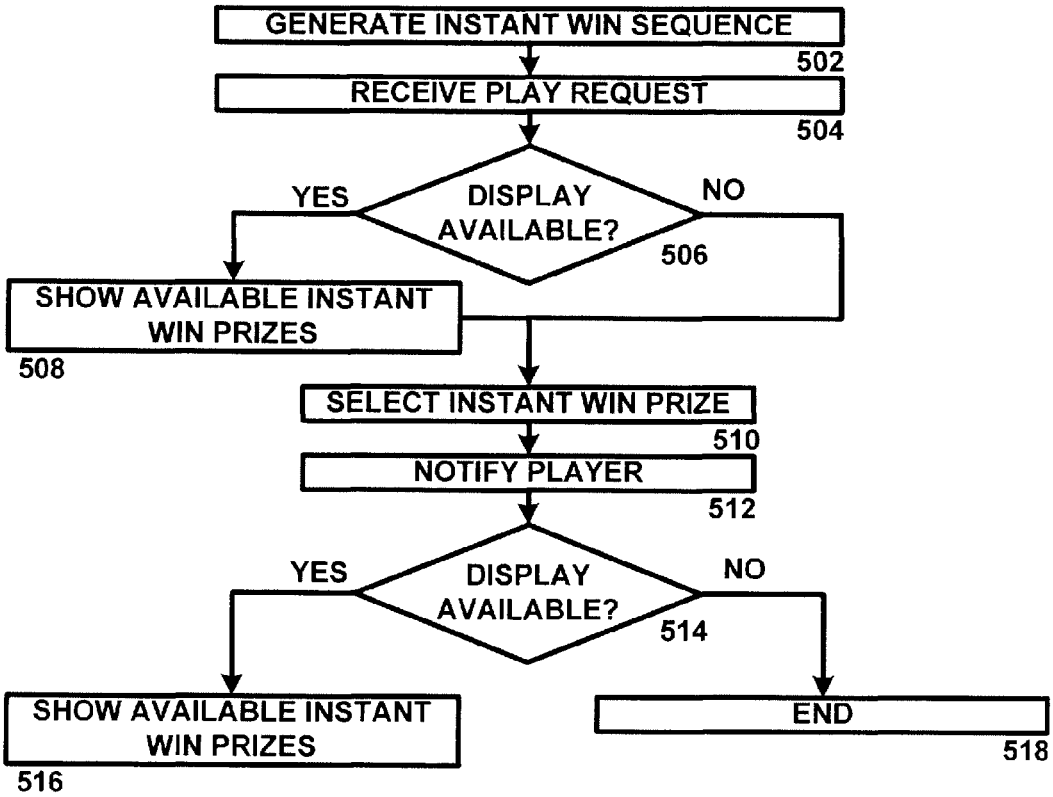
FIG. 5 is a flowchart of a method for generating and tracking reusable card-based instant win game prizes in accordance with an exemplary embodiment of the present invention.

FIG. 5 is a flowchart of a method 500 for generating and tracking reusable card-based instant win game prizes in accordance with an exemplary embodiment of the present invention. Method 500 begins at 502 where an instant win sequence is generated. In one exemplary embodiment, an instant win game for a reusable card based gaming system can have predetermined odds for winning various prize levels, such that a predetermined number of instant win prizes are generated prior to the instant win game being made available to players. The instant win sequence thus assigns instant win amounts to a draw sequence so that each purchased game entry can have an equal chance of winning of one of the instant win prizes based on a remaining prize pool. The method then proceeds to 504.

At 504, a play request is received, such as by receiving an instant win purchase or other suitable request. The method then proceeds to 506.

At 506, it determined whether a request to display available instant win prizes has been received. In one exemplary embodiment, when a play request has been received, a user may desire to view the available outstanding instant win prizes to determine what the player's odds of a successful win are. If it is determined that a display available request has been received, the method proceeds to 508 where the available instant win prizes are displayed to the user. Otherwise, the method proceeds to 510.

At 510, an instant win prize is selected, such as by determining a predetermined prize allocation for an instant win game entry or in other suitable manners. The prize allocation can include a predetermined number of jackpot game entries, a "no win" selection, a cash award, or other suitable prizes. Then method then proceeds to 512 where the player is notified of whether they have won an instant win prize and of the amount if they have one. The method then proceeds to 514.

At 514, it is determined whether a player has requested to display the available instant win prizes. In one exemplary embodiment, the user may desire to compare the "before" and "after" instant win available prizes to confirm that an actual change in the prize pool has occurred, such as to ensure that fraud has not occurred. If a display request has not been received at 514, the method proceeds to 518 and terminates. Otherwise, the process proceeds to 516 where available instant win prizes are shown. In one exemplary embodiment, the instant win prizes prior to the purchase to after the purchase can also be shown so that a user can compare the two values and amounts and can verify that the prize pool has changed accordingly.

In operation, method 500 provides an instant win gaming process for a reusable card based game that does not utilize prior art instant win technologies such as scratch off or pull tab processes. Instead, method 500 allows a reusable card based instant win game to be provided where a user owns a single card that has been registered, and instant win prizes are allocated based on predetermined instant win prize allotments.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. An apparatus for gaming, comprising:

a card reader system for reading card data from a game card associated with a player;

an instant win game system for associating an instant win game entry with the card data;

a jackpot game system for associating a jackpot game entry with the card data; and an instant win prize tracking system for displaying instant win prize history data in real time to the player, to allow the player to compare before and after instant win available prizes to confirm that an actual change in a price pool has occurred.

2. The apparatus of claim 1 further comprising a card tracking system or storing history data associated with a plurality of game cards.

3. The apparatus of claim 1 further comprising a card account system for storing account data associated with each of a plurality of game cards.

4. The apparatus of claim 1 further comprising a card game tracking system for storing game history data associated with each of a plurality of game cards and displaying a plurality of active jackpot game entries associated with one of the game cards.

5. The apparatus of claim 1 further comprising a payout tracking system for storing prize history data associated with a plurality of game cards.

6. A method for gaming, comprising:

associating each of a plurality of reusable cards with a corresponding player;

electronically reading an identifier stored on one of the plurality of reusable cards;

assigning a predetermined instant win game entry with the reusable card identifier;

assigning a jackpot game entry with the reusable card identifier; and displaying instant win prize history datain real time to the player, to allow the player to compare before and after instant win available prizes to confirm that an actual change in a price pool has occurred.

7. The method of claim 6 further comprising:

determining whether the instant win game entry is associated with prize data; and storing the prize data and the associated reusable card identifier.

8. The method of claim 6 further comprising:

determining whether the jackpot game entry is associated with prize data; and storing the prize data and the associated reusable card identifier.

9. The method of claim 6 further comprising:

determining whether the instant win game entry is associated with prize data; and updating instant win game prize data based on the prize data for the reusable card.

10. The method of claim 6 wherein electronically reading the identifier stored on one of the plurality of reusable cards further comprises:

generating a display of available instant win games; and receiving a game selection based on the display.

11. The method of claim 6 wherein electronically reading the identifier stored on one of the plurality of reusable cards further comprises:

generating a display of a plurality of available instant win games;

generating a display of outstanding instant win prizes for a selected one of the plurality of available instant win games; and receiving a game selection based on the display of instant win games.

12. An apparatus for gaming, comprising:

a card reader system for reading card data from a game card associated with a player;

a location-based instant win game system for associating an instant win game entry with the card data as a function of location data;

a jackpot game system for associating a jackpot game entry with the card data; and an instant win prize tracking system for displaying instant win prize history data in real time to the player, to allow the player to compare before and after instant win available prizes to confirm that an actual change in a price pool has occurred.

13. The apparatus of claim 12 wherein the location-based instant win game system is for associating the instant win game entry with the card data as a function of location data for a vendor, wherein the instant win game entry is made available to be purchased from predetermined vendors.

14. The apparatus of claim 12 wherein the location-based instant win game system is for associating the instant win game entry with the card data as a function of location data for the player, wherein the instant win game entry is made available to be purchased by predetermined players.

15. The apparatus of claim 12 further comprising a card game tracking system for storing game history data associated with each of a plurality of game cards.

16. The apparatus of claim 12 further comprising a card prize tracking system for storing prize history data associated with each of a plurality of game cards.

17. The apparatus of claim 12 further comprising a payout tracking system for storing prize history data associated with a plurality of game cards.

18. The method of claim 6 wherein assigning the predetermined instant win game entry with the reusable card identifier comprises assigning a location-based predetermined instant win game entry with the reusable card identifier, wherein the location-based predetermined instant win game entry is selected based on a location of a vendor.

19. The method of claim 6 wherein assigning the predetermined instant win game entry with the reusable card identifier comprises assigning a location-based predetermined instant win game entry with the reusable card identifier, wherein the location-based predetermined instant win game entry is selected based on a location of the corresponding player.

* * * * *